US009150993B2

(12) United States Patent
Bennett et al.

(10) Patent No.: US 9,150,993 B2
(45) Date of Patent: Oct. 6, 2015

(54) METHODS AND COMPOSITIONS FOR FABRIC CLEANING

(71) Applicant: Conopco, Inc., Englewood Cliffs, NJ (US)

(72) Inventors: Julie Bennett, Wirral (GB); Paul Kravchuk, Wirral (GB); Donna MacNab, Wirral (GB); Anthony McKee, Wirral (GB); Alyn James Parry, Wirral (GB); Patricia Revell, Wirral (GB); Becky Zhou, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 13/933,313

(22) Filed: Jul. 2, 2013

(65) Prior Publication Data

US 2013/0291315 A1 Nov. 7, 2013

Related U.S. Application Data

(62) Division of application No. 12/997,884, filed as application No. PCT/EP2009/057019 on Jun. 8, 2009, now abandoned.

(30) Foreign Application Priority Data

Jun. 16, 2008 (GB) ..... 0810881.3
Dec. 17, 2008 (EP) ..... 08171961

(51) Int. Cl.
*D06F 35/00* (2006.01)
*C11D 3/37* (2006.01)
*C11D 3/386* (2006.01)

(52) U.S. Cl.
CPC ..... *D06F 35/006* (2013.01); *C11D 3/3723* (2013.01); *C11D 3/38627* (2013.01); *C11D 3/38681* (2013.01)

(58) Field of Classification Search
None
See application file for complete search history.

(56) References Cited

U.S. PATENT DOCUMENTS

| | | | |
|---|---|---|---|
| 3,844,952 | A | 10/1974 | Booth |
| 5,441,672 | A | 8/1995 | Schwadtke |
| 5,565,145 | A | 10/1996 | Watson et al. |
| 5,707,950 | A | 1/1998 | Kasturi et al. |
| 6,376,446 | B1 | 4/2002 | Smadi |
| 7,670,389 | B2 | 3/2010 | Becker |
| 2005/0170987 | A1 | 8/2005 | Scheibel |
| 2006/0234895 | A1 | 10/2006 | Souter |

FOREIGN PATENT DOCUMENTS

| | | | |
|---|---|---|---|
| CA | 1210009 | | 8/1986 |
| EP | 0775191 | B1 | 3/2004 |
| EP | 1923455 | A2 | 5/2008 |
| GB | 1366905 | | 9/1974 |
| GB | 1375758 | | 11/1974 |
| GB | 1428273 | | 3/1976 |
| GB | 2317393 | A | 3/1998 |
| WO | WO9711145 | | 3/1997 |
| WO | WO9815608 | A2 | 4/1998 |
| WO | WO0060063 | A1 | 10/2000 |
| WO | WO0119507 | | 3/2001 |
| WO | WO03008525 | | 1/2003 |
| WO | WO2004074419 | | 9/2004 |
| WO | WO2006079626 | | 8/2006 |
| WO | WO2006113314 | | 10/2006 |
| WO | WO2007083262 | | 7/2007 |
| WO | WO2008148420 | A1 | 12/2008 |

OTHER PUBLICATIONS

Chanda et al., Ethoxylated Polyethylenimine Gel-Coated on Textile-Grade Acrylic Fiber. A Thermally Regenerable Superfast Sorbent for Water Desalination, Journal of Applied Polymer Science, 2004, 883-893, 93, John Wiley Periodicals.

GB Search Report in GB application GB0810881.3 dated Feb. 3, 2009.

PCT International Search Report in PCT application PCT/EP2009/057019.

European Patent Office, Communication of a Notice of Opposition in EP2135934 (EP08171961.9), The Procter & Gamble Company, dated Aug. 10, 2012.

*Primary Examiner* — Christian Fronda
(74) *Attorney, Agent, or Firm* — Greenberg Traurig, LLP

(57) ABSTRACT

The invention provides a method of laundering fabric which uses a pourable liquid detergent composition comprising 10-40% wt of surfactant, essentially consisting of nonionic and/or anionic surfactant (typically less than 90% wt LAS and at least 10% wt of nonionic surfactant) in which 10-40% wt of surfactant preferably passes the Calcium Tolerance Test described in the patent. The composition comprises no more than 15% wt of soap, (present as a minority in wt % terms of the total surfactant). In the method, the composition is diluted by a factor of greater than 500 to obtain a wash liquor which comprises 0.8-0.05 g/l of surfactant, and, the wash liquor is contacted with fabrics. The composition may further comprise one or more of and preferably combinations of lipase, polyethyleneimine, a blue violet dye, preferably with an optical adsorption peak in the range 540-600 nm, a fluorescer, a dye transfer inhibition polymer, a polycarboxylate anti-redeposition agent, a soil release polymer and a perfume (preferably encapsulated).

15 Claims, No Drawings

METHODS AND COMPOSITIONS FOR FABRIC CLEANING

This is a Divisional Application of U.S. application Ser. No. 12/997,884, filed Feb. 1, 2011, which is a national stage application under 35 U.S.C. §371 of PCT International Application PCT/EP2009/057019 filed Jun. 8, 2009, which claims priority under 35 U.S.C. §119 to EP Application No. 08171961 filed Dec. 17, 2008 and UK Application No. 0810881.3 filed Jun. 16, 2008; all of which are incorporated herein in their entirety, by reference.

TECHNICAL FIELD

The present invention is concerned with improvements relating to fabric cleaning and, in particular, with an improved process for laundering fabrics using a concentrated detergent.

BACKGROUND

Isotropic liquid detergents for use in laundry comprise varying concentration levels of surfactant. 10 to 15% wt is commonplace in Portugal and Spain, 18 to 27% wt typical in the Benelux countries, Germany and Italy, while levels of 35 to 40% wt surfactant have been used in the UK and France.

While moderately concentrated detergent compositions for laundry use have been known from the literature and available in the marketplace for some time, there has been a recent trend towards more concentrated liquid products and a "three-times concentrate" (Persil™ "Small and Mighty") was launched, in the UK. The dosage instructions for this product suggest that 35 ml of the composition should be used for a normal product load. With less concentrated products volume dosages are typically higher, so as to reach the same in-wash concentrations of non-soap surfactant.

Reasons for this trend towards concentrated products have included a desire to make more environmentally friendly products, which use less packaging, require fewer chemicals for their manufacture and require less energy to manufacture and transport them. Concentrated products also offer the advantages of taking up less shelf and storage space. Concentrated products deliver the same level of surfactant into the wash liquor from a smaller volume of product, and they are generally formulated by taking water out.

However, there are limits to the extent to the benefits which can be obtained by simply concentrating products. Particular problems occur with dispensing and delivery of products. For example, at particularly high concentrations liquid products may exhibit unacceptable or unstable viscosities and solid products may exhibit hydroscopicity and poor flow or caking. These known disadvantages, such as maintenance of product stability, pourability and product appearance have lead to a number of proposals.

A "four times" concentrate has been launched in Australia under the brand name "Orange power" and is described as "a 4× concentrate enzyme liquid detergent". Its dosage recommendation is 25 ml (a capful) for top loading washing machines and ¾ of a cap for front loaders.

Unit dosage has been suggested to overcome some of the known problems but this can lead to dissolution problems. Moreover, rising cost of surfactants, especially those from oil-based materials has led to pressures to remove surfactant as well.

WO 2004/074419 (Novozyme) suggests she replacement of part of the surfactant, builder, bleach, and fillers in a detergent with enzymes. This is said to result in a significant reduction of the volume and weight of the detergent necessary for one wash. After partial replacement by enzymes, levels of surfactant of less than 30 wt % preferably 4 to 20 wt %, more preferably 5 to 15 wt % are disclosed. Any soil suspending polymer is said to foe reduced to 0 to 6 wt % after it too is partially or fully replaced by enzymes. Lipase is used to boost oily soil detergency. In the examples in-wash non-soap surfactant levels as low as 0.18 g/L are disclosed. The drawback with the approach suggested in this document is that it is too dependent on enzymes which are expensive and are sensitive to storage and use conditions. Furthermore the stains selected to exemplify cleaning are apparently chosen to be responsive to enzymes and consequently do not demonstrate the solution to the more realistic problem of detergency against everyday dirt and stains, such as clay.

WO 2006/113314 (P&G) discloses a liquid laundry detergent composition comprising:

(a) from about 5 to about 20000 LU/g of a "first wash" lipase, which is a polypeptide having an amino acid sequence which has at least 90% identity with the wild-type lipase derived from *Humicola lanuginosa* strain DSM 4109, and, (b) from about 0.01 wt % to about 10 wt % by weight of the composition of a modified polyethyleneimine polymer which comprises a polyethyleneimine backbone of about 300 to about 10000 weight average molecular weight; and (c) the balance of the composition comprising a liquid carrier.

This patent publication states that alkyl ethoxy sulfate surfactant may be present in the composition from about 5% to about 30%; or from about 7% to 16% by weight of the composition. Additional surfactants include up to 7% of nonionic and/or anionic co-surfactants. Aqueous washing solutions are disclosed to comprise 500 to 7,000 ppm (0.5 to 7 g/L) of the composition, preferably 1000 to 3000 ppm. If the non-soap surfactant level varies from 11 to 21 wt %, as in the examples, this would provide a preferred wash solution non-soap surfactant concentration of from 0.1 to 0.6 g/l. Although the general disclosure allows for high levels of EPEI, the actual levels used are too low to realise the benefit from the low dose of surfactant to the wash from a low volume dose of the composition.

BRIEF DESCRIPTION OF THE INVENTION

We have now determined that significant benefits as regards elements of the environmental footprint of the laundering process may be obtained by using low dosages of concentrated products of a specific formulation class at relatively high dilution. Surprisingly, fully formulated products according to the present invention exhibit better removal of everyday dirt and stains than commercial products which, in use, are dosed at much higher surfactant levels. For reasons which will be explained further below the claimed products also outperform the closest prior art in terms of treatment of everyday dirt and stains at an equivalent dose of chemicals.

Accordingly, a first aspect of the present invention provides a method of laundering fabric which comprises the steps of:

a) providing a pourable liquid detergent composition comprising 10 to 40% wt of surfactant, essentially consisting of nonionic and/or anionic and/or zwitterionic surfactant which 10 to 40% wt of surfactant preferably passes the Calcium Tolerance Test described herein, and in addition, no more than 15% wt, preferably no more than 10% wt, of a soap, with the proviso that any soap present is present as a minority in wt% terms of the total surfactant, b) diluting a dose of said detergent composition in water by a factor of greater than 500 to obtain a wash liquor which comprises 0.8 to 0.035, preferably 0.5 to 0.05, g/l of non-soap surfactant, and, c) washing fabrics with the wash liquor so formed.

In typical use conditions, this would involve a dosage of about 20 ml of concentrated composition into a washing machine which may hold 10 to 15 liters of water.

In the context of the present invention, pourable means that it can be poured. Preferably it has a shear viscosity (at 25 Celcius) of below preferably below 2 Pa·s at a shear rate of 21 $s^{-1}$. Preferred viscosities are in the range 1.0-0.1 Pa·s. The composition may be shear thinning.

Larger dosage units can be employed but it is preferred that the dose is less than 35 ml, more preferably less than 30 ml, and most preferably less than 25 ml per wash, even being ml or less per wash. Preferably, the wash liquor obtained comprises 0.25 to 0.55 g/l of non-soap surfactant, for example 0.4 g/L or lower. Doses may be measured by hand, more preferably metered by a suitable device or provided as pre-measured unit doses. The use of a container with metering means to deliver a dose with a dose to dose variability of less than 20% wt and preferably less than 10% wt is preferred.

The Calcium Tolerance Test used herein is that defined in EP1771543. A surfactant blend is prepared at a concentration of 0.7 g/l in water containing sufficient calcium ions to give a French Hardness of 40 degrees. Other electrolytes such as sodium chloride, sodium sulphate, sodium hydroxide are added as necessary to adjust the ionic strength to 0.5M and the pH to 10. The absorption of light of wavelength 540 nm through 4 mm of sample is measured 15 minutes after sample preparation. Ten measurements are made and an average value is calculated. Samples that give an absorption value of less than 0.08 are deemed to be calcium tolerant.

The dilution factor in the method of the first aspect of the present invention is by a factor of at least 500, by which is meant that one volume of composition is mixed with at least 500 volumes of water. The dilution factor is preferably less than 2500. Particularly preferred dilution factors fall in the range of 500 to 1500, most preferably 500 to 1000.

Preferably the detergent composition comprises not more than 35% wt, even more preferably not more than 30% wt, of non-soap surfactant. Typically the total surfactant will be a mixture of nonionic and anionic surfactant. Preferably, the anionic surfactant is predominately, and more preferably essentially, a non-soap anionic surfactant. In particularly preferred embodiments of the invention the anion of the anionic surfactant is selected from the group consisting of linear alkyl benzene sulphonate (LAS), primary alkyl sulphate (PAS), alkyl, ether sulphate (AES) and mixtures thereof. In some embodiments zwitterionic surfactants are used as part of the surfactant mixture. Zwitterionics, in particular betaines, improve particulate soil detergency in the compositions of the invention.

We have determined that instead of further pursuing attempts to deliver the same levels of surfactant in the wash liquor from smaller quantities of product, it is more effective to deliver smaller quantities of surfactant into the wash liquor and rebalance she cleaning performance using polymers, preferably EPEI, optionally with soil-release polymers, catalytic cleaning systems, preferably including a lipase enzyme, and optical modifiers, preferably shading dye and/or fluorescer. However, it is advantageous not to remove surfactants completely from she composition.

In order to further concentrate (or compact) the prior art compositions like Persil Small and Mighty™ to achieve a 5× concentrate (20 ml dose) containing the same level of non-soap surfactant active would result in an 82 wt % active mix (expressed as neutralised surfactant). At this level of active if one tries to add in the other ingredients found in the existing products to give the same in wash concentrations then the formulation becomes 87.3 wt % solids before one attempts to include the necessary buffer/hydrotrope or neutralisation agent. At such high levels of incorporation the system either becomes impossible or else it is so constrained in terms of surfactant type that may be used that it becomes an impractical commercial proposition. (E.g. use of 100% NI surfactant). So, for example, for a typical LAS, nonionic, SLES and soap, surfactant system: 10% MEA and 10% of a hydrotrope such as MPG is required to achieve a stable composition with the desired pH. This would be impossible even with zero water present if the other ingredients already add up to over 80 wt %.

We have also found that there are many benefits in reducing the level of surfactant as regards the efficiency of deposition of certain polymers, for instance coil release polymers, and other benefit agents.

A particularly advantageous benefit of the reduction of surfactant levels in the wash using the method and composition of the invention is that shading dyes are better deposited.

Preferably, the method of the invention is conducted in a washing machine, more preferably in a non-vertical axis machine, most preferably in a horizontal-axis machine wish a drawer dispensing system.

As noted above, the performance of the compositions in the method according to the invention may be further improved by the presence of one or more of enzymes, polymers and shading dyes.

It is particularly preferable that at least one enzyme is present in the compositions of the invention. Lipase is a particularly preferred enzyme. The composition prior to the dilution step (b) preferably contains from about 5 to about 20000 LU/g of a lipase. Preferred lipase enzymes include those of bacterial or fungal origin. Chemically modified or protein engineered mutants are included. Examples of useful lipases include lipases from *Humicola*, more preferably ones which comprise a polypeptide having an amino acid sequence which has at least 90% sequence identity with the wild-type lipase derived from *Humicola lanuginose*, most preferably strain DSM 4109. However, at the low surfactant levels employed in the present invention it has been determined that so-called "multi-wash" lipase enzymes show a single-wash benefit. The amount of lipase enzyme protein used in the wash is set to be at the high side of what is normal (>5 mg, pref greater than 8 mg per wash). This means that the amount in the composition is higher than typically found in liquid detergents. This can be seen by the ratio of non-soap surfactant to lipase enzyme, in particular. A particularly preferred lipase enzyme is available under the trademark Lipoclean™ from Novozymes.

As will be described in further detail below, a range of possible polymers may be employed to improve the performance of the compositions used in the method of the present invention. Again, the efficacy of these polymers is much improved by the reduction in the level of surfactant present in the wash. The ratio of polymer to surfactant is also set to be higher than normal.

One preferred class of polymer is the fabric-substantive polymers comprising at least one of (i) saccharide or (ii) dicarboxylic acid and polyol monomer units. Typically these have soil release properties while they can have a primary detergency effect the generally assist in subsequent cleaning. Preferably these should be present at a level of at least 2% wt preferably at least 3% of the composition.

Another particularly preferred class of polymer is polyethylene imine, preferably modified polyethylene imine. Polyethylene imines are materials composed of ethylene imine units —CH2CH2NH— and, where branched, the hydrogen on the nitrogen is replaced by another chain of ethylene imine units. These polyethyleneimines can be prepared, for example, by polymerizing ethylene inline in the presence of a catalyst such as carbon dioxide, sodium bisulfite, sulfuric acid, hydrogen peroxide, hydrochloric acid, acetic acid, and the like. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951.

Preferentially, these comprise a polyethyleneimine backbone of about 300 so about 10000 weight average molecular weight; wherein the modification of she polyethyleneimine backbone is:

a) one or two alkoxylation modifications per nitrogen atom in the polyethyleneimine backbone, the alkoxylation modification comprising the replacement of a hydrogen atom by a polyalkoxylene chain having an average of about 1 to about 40 alkoxy moieties per modification, wherein the terminal alkoxy moiety of the alkoxylation modification is capped with hydrogen, a $C_1$-$C_4$ alkyl, an anionic group or mixtures thereof;
b) a substitution of one $C_1$-$C_4$ alkyl moiety and one or two alkoxylation modifications per nitrogen atom in the polyethyleneimine backbone, the alkoxylation modification comprising the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl an anionic group or mixtures thereof; or
c) a combination thereof.

The polyethyleneimine polymer is present in the composition provided in step (a), prior to the dilution step (b), preferably at a level of between 0.01 and 25 wt %, but more preferably at a level of at least 3 wt % and/or less than 9.5 wt %, most preferably from 4 to 9 wt % and with a ratio of EPEI to non-soap surfactant of from 1:2 to 1:7, preferably from 1:3 to 1:6, or even to 1:5.

The combination of low non-soap surfactant and the presence of both lipase and polyethyleneimine has been found particularly advantageous and a preferred method of laundering fabric according the present invention comprises the steps of:

a) providing a pourable liquid detergent composition comprising:
   i) 10-40% wt of surfactant, essentially consisting of nonionic and/or anionic and/or zwitterionic surfactant which 10-40% wt of surfactant preferably passes the Calcium Tolerance Test described herein, and in addition, no more than 15% wt, preferably no more than 10% wt, of a soap, with the proviso that any soap present is present as a minority in wt % terms of the total surfactant,
   ii) 5 to 20000 LU/g of a lipase, and,
   iii) 0.01, preferably 3, to 25 wt % polyethyleneimine;
b) diluting a dose of said detergent composition in water by a factor of greater than 500 to obtain a wash liquor which comprises 0.8 to 0.05 g/l of non-soap surfactant, and
c) contacting said wash liquor with fabrics.

Significantly, the compositions of the invention, while using less surfactant per wash than fully formulated commercial, compositions exhibit at least parity in performance and on many stains and dirt show improved performance.

In a second aspect the invention therefore comprises the compositions of step (a) of the process provided either in a multidose container or in the form of a liquid unit dose in a soluble sachet.

In a third aspect of she invention the concentrated composition is prediluted with a small amount of water to enable the normal volume to be dosed (e.g. 35 ml). This retains the advantages of a low amount of chemical dosed per wash and if the dilution step is carried out when the composition is bottled it can aid in the stability of the formulation on storage. When this process modification is used the dilution factor will be adjusted to compensate for the greater dose of more dilute material added to the wash. Thus the extent of dilution can be as low as 280 volumes of water to one dose from the bottle of the concentrate with extra make up wafer in a multi-dose bottle.

Thus according to a third aspect of the invention there is provided a method of laundering fabric which comprises the steps of;

a) providing a multidose container which contains a pourable liquid detergent composition comprising 10-40% wt of surfactant, essentially consisting of nonionic and/or anionic and/or zwitterionic surfactant, and in addition, no more than 15% wt, preferably no more than 10% wt, of a soap, with the proviso that any soap present is present as a minority in wt % terms of the total surfactant,
b) mixing a dose of the detergent composition comprising 4 to 8 g non-soap surfactant and at least 0.5 g of a polyethyleneimine with water to obtain a wash liquor and,
c) washing fabrics with the wash liquor so formed.

Advantageously, the dose in step (b) further comprises at least 0.01 g active lipase protein (or greater than 2500 LU). It may alternatively, or additionally, comprise at least 0.5 g of soil release polymer. The dose, prior to dilution, should contain 5 to 20 000 LU/g when lipase is present.

DETAILED DESCRIPTION OF THE INVENTION

In order that the invention may be further and better understood and carried forth into practice it will be described hereinafter with reference to various preferential but non-limiting features.

Surfactants:

Surfactants assist in removing soil from the textile materials and also assist in maintaining removed soil in solution or suspension in the wash liquor. Anionic and/or nonionic surfactants, preferably in a calcium tolerant blend, are an essential feature of the present invention. Surfactant systems which consist only of linear alkyl benzene sulphonate (LAS) are generally calcium intolerant.

When required, in order to ensure calcium tolerance, surfactant systems should generally avoid having levels of LAS above 90% wt. Nonionic-free systems with 95% wt LAS can be made provided that some zwitterionic surfactant, such as sulphobetaine, is present. Generally it is preferred to use less than 90% wt LAS and at least 10% wt of nonionic surfactant.

Preferred alkyl ether sulphates are $C_8$-$C_{15}$ alkyl and have 2-10 moles of ethoxlation. Preferred alkyl sulphates are alkylbenzene sulphonates, particularly linear alkylbenzene sulphonates having an alkyl chain length of $C_8$-$C_{15}$. The counter ion for anionic surfactants is generally an alkali metal, typically sodium, although other counter-ions such as MEA, TEA or ammonium can be used. Suitable anionic surfactant materials are available in the marketplace as the 'Genapol'™ range from Clariant.

Nonionic surfactants include primary and secondary alcohol ethoxylates, especially $C_8$-$C_{20}$ aliphatic alcohol ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkyl polyglycosides, glycerol monoethers and polyhydroxy amides (glucamide). Mixtures of nonionic surfactant may be used. When included therein the composition contains from 0.2 wt % to 40 wt %, preferably 1 wt % to 20 wt %, more preferably 5 to 15 wt % of a non-ionic surfactant, such as alcohol ethoxylate, nonylphenol ethoxylate, alkylpolyglycoside, alkyldimethylamineoxide, ethoxylated fatty acid monoethanolamide, fatty acid monoethanolamide, polyhydroxy alkyl fatty acid amide, or N-acyl N-alkyl derivatives of glucosamine ("glucamides").

Nonionic surfactants that may be used include the primary and secondary alcohol ethoxylates, especially the $C_8$-$C_{20}$ aliphatic alcohols ethoxylated with an average of from 1 to 35 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol.

Shading Dyes:

As noted above, shading dye cars be used to improve the performance of the compositions used in the method of the present invention. The deposition of shading dye onto fabric is improved when they are used in compositions of the invention and according to the process of the invention. Preferred dyes are violet or blue. It is believed that the deposition on fabrics of a low level of a dye of these shades, masks yellowing of fabrics. A further advantage of shading dyes is that they can be used to mask any yellow tint in the composition itself.

Suitable and preferred classes of dyes are discussed below.

Direct Dyes:

Direct dyes (otherwise known as substantive dyes) are the class of water soluble dyes which have a affinity for fibres and are taken up directly. Direct violet and direct blue dyes are preferred.

Preferably the dye are bis-azo or tris-azo dyes are used.

Most preferably, the direct dye is a direct violet of the following structures:

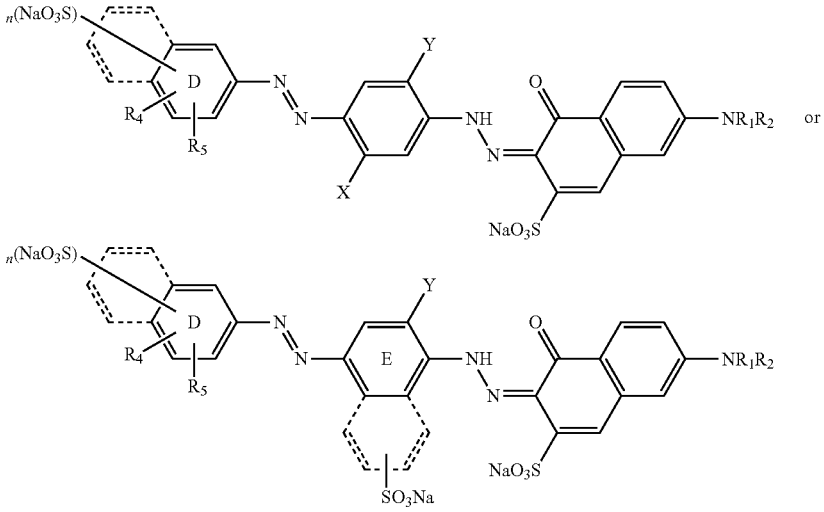

wherein:

ring D and E may be independently naphthyl or phenyl as shown;

$R_1$ is selected from: hydrogen and $C_1$-$C_6$-alkyl, preferably hydrogen;

$R_2$ is selected from: hydrogen, $C_1$-$C_4$-alkyl, substituted or unsubstituted phenyl and substituted or unsubstituted naphthyl, preferably phenyl;

$R_3$ and $R_4$ are independently selected from: hydrogen and $C_1$-$C_4$-alkyl, preferably hydrogen or methyl;

X and Y are independently selected from: hydrogen, $C_1$-$C_4$-alkyl and $C_1$-$C_4$-alkoxy; preferably the dye has X=methyl; and, Y=methoxy and n is 0, 1 or 2, preferably 1 or 2.

Preferred dyes are direct violet 7, direct violet 9, direct violet 11, direct violet 26, direct violet 31, direct violet 35, direct violet 40, direct violet 41, direct violet 51, and direct violet 99. Bis-azo copper containing dyes such as direct violet 66 may be used. The benzidene based dyes are less preferred.

Preferably the direct dye is present at 0.000001 to 1 wt % more preferably 0.00001 wt % to 0.0010 wt % of the composition.

In another embodiment the direct dye may be covalently linked to the photo-bleach, for example as described in WO2006/024612.

Acid Dyes:

Cotton substantive acid dyes give benefits to cotton containing garments. Preferred dyes and mixes of dyes are blue or violet. Preferred acid dyes are:

(i) azine dyes, wherein the dye is of the following core structure;

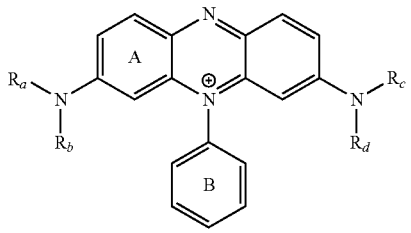

wherein $R_a$, $R_b$, $R_c$ and $R_d$ are selected from: H, a branched or linear C1 to C7-alkyl chain, benzyl a phenyl, and a naphthyl;

the dye is substituted with at least, one $SO_3^-$ or —$COO^-$ group; the B ring does not carry a negatively charged group or salt thereof;

and the A ring may further substituted to form a naphthyl; the dye is optionally substituted by groups selected from: amine, methyl, ethyl, hydroxyl, methoxy, ethoxy, phenoxy, Cl, Br, I, F, and $NO_2$.

Preferred azine dyes are: acid blue 98, acid violet 50, and acid blue 59, more preferably acid violet 50 and acid blue 98.

Other preferred non-azine acid dyes are acid violet 17, acid black 1 and acid blue 29.

Preferably the acid dye is present at 0.0005 wt % to 0.01 wt % of the formulation.

Hydrophobic Dyes

The composition may comprise one or more hydrophobic dyes selected from benzodifuranes, methine, triphenylmethanes, napthalimides, pyrazole, napthoquinone, anthraquinone and mono-azo or di-azo dye chromophores. Hydrophobic dyes are dyes which do not contain any charged water solubilising group. Hydrophobic dyes may be selected from the groups of disperse and solvent dyes. Blue and violet anthraquinone and mono-azo dye are preferred.

Preferred dyes include solvent violet 13, disperse violet 27 disperse violet 26, disperse violet 28, disperse violet 63 and disperse violet 77.

Preferably the hydrophobic dye is present at 0.0001 wt % no 0.005 wt % of she formulation.

Basic Dyes

Basic dyes are organic dyes which carry a net positive charge. They deposit onto cotton. They are of particular utility for used in composition that contain predominantly cationic surfactants. Dyes may be selected from the basic violet and basic blue dyes listed in the Colour Index International.

Preferred examples include triarylmethane basic dyes, methane basic dye, anthraquinone basic dyes, basic blue 16, basic blue 65, basic blue 66, basic blue 67, basic blue 71, basic blue 159, basic violet 19, basic violet 35, basic violet 38, basic violet 48; basic blue 3, basic blue 75, basic blue 95, basic blue 122, basic blue 124, basic blue 141.

Reactive Dyes

Reactive dyes are dyes which contain an organic group capable of reacting with cellulose and linking the dye to cellulose with a covalent bond. They deposit onto cotton.

Preferably the reactive group is hydrolysed or reactive group of the dyes has been reacted with an organic species such as a polymer, so as to the link the dye to this species. Dyes may be selected from the reactive violet and reactive blue dyes listed in the Colour Index International.

Preferred examples include reactive blue 19, reactive blue 163, reactive blue 182 and reactive blue, reactive blue 96.

Dye Conjugates

Dye conjugates are formed by binding direct, acid or basic dyes to polymers or particles via physical forces. Dependent on the choice of polymer or particle they deposit on cotton or synthetics. A description is given in WO2006/055787.

Particularly preferred dyes are: direct violet 7, direct violet 9, direct violet 11, direct violet 26, direct violet 31, direct violet 35, direct violet 40, direct violet 41, direct violet 51, direct violet 99, acid blue 98, acid violet 50, acid blue 59, acid violet 17, acid black 1, acid blue 29, solvent violet 13, disperse violet 27 disperse violet 26, disperse violet 28, disperse violet 63, disperse violet 77 and mixtures thereof.

Fluorescent Agents:

In order to further improve whiteness, it is convenient and advantageous to include a fluorescer in the compositions of the invention. The composition therefore preferably further comprises a fluorescent agent (optical brightener).

Fluorescent agents are well known and many such fluorescent agents are available commercially. Usually, these fluorescent agents are supplied and used in the form of their alkali metal salts, for example, the sodium salts.

The total amount of the fluorescent agent or agents used in the composition is generally from 0.005 to 2 wt %, more preferably 0.01 to 0.1 wt %.

Preferred classes of fluorescer are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazolone compounds, e.g. Blankophor SN.

Preferred fluorescers are: sodium 2 (4-styryl-3-sulfophenyl)-2H-napthol[1,2-d]trazole, disodium 4,4'-bis{[(4-anilino-6-(N methyl-N-2 hydroxyethyl)amino 1,3,5-triazin-2-yl)]amino}stilbene-2-2' disulfonate, disodium 4,4'-bis{[(4-anilino-6-morpholino-1,3,5-triazin-2-yl)]amino}stilbene-2-2' disulfonate, and disodium 4,4'-bis(2-sulfoslyryl)biphenyl.

Shading dye can be used in the absence of fluorescer, but it is especially preferred to use a shading dye in combination with a fluorescer, for example in order to reduce yellowing due to chemical changes in adsorbed fluorescer.

A particularly preferred embodiment, the present invention provides a method of laundering fabric which comprises the steps of:

a) providing a pourable liquid detergent composition (preferably with the above-mentioned enzyme and polymers present) comprising:
   i) a blue violet dye, preferably with an optical adsorption peak in the range 540-600 nm, preferably a bis-azo direct dye, preferably at a level of 0.000001-1 wt %,
   ii) optionally fluorescer, preferably at a level of 0.005 to 2 wt %, and,
   iii) 10-40% wt of surfactant, essentially consisting of non-ionic and/or anionic and/or zwitterionic surfactant which 10-40% wt of surfactant preferably passes the Calcium Tolerance Test described herein, and in addition, no more than 15% wt, preferably no more than 10% wt, of a soap, with the proviso that any soap present is present as a minority in wt % terms of the total surfactant,
b) diluting a dose of said detergent composition in water by a factor of greater than 500 to obtain a wash liquor which comprises 0.8 to 0.035 g/l of non-soap surfactant, and
c) washing fabrics with the wash liquor so formed.

Polymers:

The composition preferably comprises one or more polymers. Polymers can assist in the cleaning process by helping to retail soil in solution or suspension and/or preventing the transfer of dyes. Polymers can also assist in the soil-removal process. Dye transfer, anti-redeposition and soil-release polymers are described in further detail below.

Dye Transfer Inhibitors:

Detergent compositions often employ polymers as so-called 'dye-transfer inhibitors'. These prevent migration of dyes, especially during long soak times. Any suitable dye-transfer inhibition agents may be used in accordance with the present invention. Generally, such dye-transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof.

Nitrogen-containing, dye binding, DTI polymers are preferred. Of these polymers and co-polymers of cyclic amines such as vinyl pyrrolidone (PVP), and/or vinyl imidazole (PVI) are preferred.

Polyamine N-oxide polymers suitable for use herein contain units having the following structural formula: $R\text{-}A_x\text{-}P$; wherein P is a polymerizable unit to which an N—O group can be attached or the N—O group can form, part of the polymerizable unit; A is one of the following structures: —NC(O)—, —C(O)O—, —S—, —O—, —N═; x is 0 or 1; and R is an aliphatic, ethoxylated aliphatic, aromatic, heterocyclic or alicyclic group or combination thereof to which the nitrogen of the N—O group can be attached or the N—O group is part of these groups, or the N—O group can be attached to both units.

Preferred poly amine N-oxides are those wherein R is a heterocyclic group such as pyridine, pyrrole, imidazole, pyrrolidine, piperidine and derivatives thereof. The N—O group can be represented by the following general structures: $N(O)(R')_{0-3}$, or $=N(O)(R')_{0-1}$, wherein each R' independently represents an aliphatic, aromatic, heterocyclic or alicyclic group or combination thereof; and the nitrogen of the N—O group can be attached or form part of any of the aforementioned groups. The amine oxide unit of the poly amine N-oxides has a $pK_a<10$, preferably $pK_a<7$, more preferably $pK_a<6$.

Any polymer backbone can be used provided the amine oxide polymer formed is water-soluble and has dye transfer inhibiting properties. Examples of suitable polymeric backbones are polyvinyls, polyalkylenes, polyesters, polyethers, polyamides, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferably 1,000 to 500,000; most preferably 5,000 to 100,000. This preferred class of materials is referred to herein as "PVNO". A preferred polyamine N-oxide is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (as a class, referred to as PVPVI) are also preferred. Preferably the PVPVI has an average molecular weight range from 5,000 to 1,000,000, more preferably from 5,000 to 200,000, and most preferably from 10,000 to 20,000, as determined by light scattering as described in Barth, et al., *Chemical Analysis*, Vol. 113. "Modern Methods of Polymer Characterization". The preferred PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched. Suitable PVPVI polymers include Sokalan™ HP56, available commercially from BASF, Ludwigshafen, Germany.

Also preferred as dye transfer inhibition agents are polyvinylpyrrolidone polymers (PVP) having an average molecular weight of from about 5,000 to about 400,000, preferably from about 5,000 to about 2000,000, and more preferably from about 5,000 to about 50,000. PVP's are disclosed for example in EP-A-262,897 and EP-A-256,696. Suitable PVP polymers include Sokalan™ HP50, available commercially from BASF. Compositions containing PVP can also contain polyethylene glycol (PEG) having an average molecular weight from about 500 to about 100,000, preferably from about 1,000 to about 10,000. Preferably, the ratio of PEG to PVP on a ppm basis delivered, in wash solutions is from about 2:1 to about 50:1, and more preferably from about 3:1 to about 10:1.

Also suitable as dye transfer inhibiting agents are those from the class of modified polyethyleneimine polymers, as disclosed for example in WO-A-0005334. These modified polyethyleneimine polymers are water-soluble or dispersible, modified polyamines. Modified polyamines are further disclosed in U.S. Pat. No. 4,548,744; U.S. Pat. No. 4,597,898; U.S. Pat. No. 4,877,896; U.S. Pat. No. 4,891,160; U.S. Pat. No. 4,976,879; U.S. Pat. No. 5,415,807; GB-A-1,537,288; GB-A-1,498,520; DE-A-28 29022; and JP-A-06313271.

The modified ethoxylated polyamines (EPEI) are described above and are generally linear or branched poly (>2) amines. The amines may be primary, secondary or tertiary. A single or a number of amine functions are reacted with one or more alkylene oxide groups to form a polyalkylene oxide side chain. The alkylene oxide can be a homopolymer (for example ethylene oxide) or a random or block copolymer. The terminal group of the alkylene oxide side chain can be further reacted to give an anionic character to the molecule (for example to give carboxylic acid or sulphonic acid functionality).

Preferably the composition according to the present invention comprises a dye transfer inhibition agent selected from polyvinylpyrridine N-oxide (PVNO), polyvinyl pyrrolidine (PVP), polyvinyl imidazole, N-vinylpyrrolidone and N-vinylimidazole copolymers (PVPVI), copolymers thereof, and mixtures thereof.

The amount of dye transfer inhibition agent in the composition according to the present invention will be from 0.01 to 10%, preferably from 0.02 to 8, or even to 5%, more preferably from 0.03 to 6, or even to 2%, by weight of the composition. It will be appreciated that the dye transfer inhibition agents will assist in the preservation of whiteness by preventing the migration of dyes from place to place. This preservation of whiteness assists in cleaning and counteracts the reduction in surfactants present in the wash liquor.

Anti-Redeposition Polymers:

Anti-redeposition polymers are typically polycarboxylate materials. Polycarboxylate materials, which can be prepared by polymerizing or copolymerizing suitable unsaturated monomers, are preferably admixed in their acid form. Unsaturated monomeric acids that can be polymerized to form suitable polycarboxylates include acrylic acid, maleic acid (or maleic anhydride), fumaric acid, itaconic acid, aconitic acid, mesaconic acid, citraconic acid and methylenemalonic acid. The presence in the polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polycarboxylates can be derived from acrylic acid. Such acrylic acid-based polymers which are useful herein are the water-soluble salts of polymerised acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967. In the present invention, the preferred polycarboxylate is sodium polyacrylate.

Acrylic/maleic-based copolymers may also be used as a preferred component of the anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful polymers maleic/acrylic/vinyl alcohol terpolymers. Such materials are also disclosed in EP 193,360, including, for example, the 45/43/10 terpolymer of acrylic/maleic/vinyl alcohol.

Polyethylene glycol (PEG) can act as a clay soil removal-antiredeposition agent. Typical molecular weight ranges for these purposes range from about 500 to about, 100,000, preferably from about 1,000 to about 50,000, more preferably from about 3,000 to about 10,000. Polyaspartate and polyglutamate dispersing agents may also be used. Any polymeric soil release agent known to those skilled in the art can optionally be employed in compositions according to the invention. Polymeric soil release agents are characterized by having both hydrophilic segments, to hydrophilize the surface of hydrophobic fibres, such as polyester and nylon, and hydrophobic segments, to deposit upon hydrophobic fibres and remain adhered thereto through completion of washing and rinsing cycles and, thus, serve as an anchor for the hydrophilic segments. This can enable stains occurring subsequent to treatment with the soil release agent to be more easily cleaned in later washing procedures.

The amount of anti redeposition polymer in the composition according to the present invention will be from 0.01 to 10%, preferably from 0.02 to 8%, more preferably from 0.03 to 6%, by weight of the composition.

Soil Release Polymers:

Generally the soil release polymers for polyester will comprise polymers of aromatic dicarboxylic acids and alkylene glycols (including polymers containing polyalkylene glycols).

The polymeric soil release agents useful herein especially include those soil release agents having:

(a) one or more nonionic hydrophilic components consisting essentially of:
  (i) polyoxyethylene segments with a degree of polymerization of at least 2, or
  (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or
  (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising:
  (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower,
  (ii) $C_4$-$C_6$ alkylene or oxy $C_4$-$C_6$ alkylene segments, or mixtures therein,
  (iii) poly (vinyl ester) segments, preferably polyvinyl acetate), having a degree of polymerization of at least 2, or (iv) $C_1$-$C_4$ alkyl ether or $C_4$ hydroxyalkyl ether substituents, or mixtures therein, wherein said substituents are present in the form of $C_1$-$C_4$ alkyl ether or $C_4$ hydroxyalkyl ether cellulose derivatives, or mixtures therein, and such cellulose derivatives are amphiphilic, whereby they have a sufficient level of $C_1$-$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$-$C_6$ alkylene hydrophobe segments include, but are not limited to, end-caps of polymeric soil release agents such as $MO_3S(CH_2)_0OCH_2CH_2O$—, where M is sodium and n is an integer from 4-6, as disclosed in U.S. Pat. No. 4,721,580, issued Jan. 26, 1988 to Gosselink.

Soil release agents characterized by poly(vinyl ester) hydrophobe segments include graft copolymers of poly(vinyl ester), e.g., $C_1$-$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred sold release agent is a copolymer having random blocks of ethylene terephthalate and polyethylene oxide (PEG) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10-15% by weight of ethylene terephthalate units together with 90-80% by weight of polyoxyethylene terephthalate units, derived from a polyoxyethylene glycol of average molecular weight 300-5,000. Examples of this polymer include the commercially available material ZELCON 5126 (from DuPont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Fat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoarolyl, end-capped terephthalate esters.

If utilized, soil release agents will generally comprise from about 0.01% to about 10.0%, by weight, of the detergent composition, typically greater than or equal to 0.2 wt % even from 3 wt % to 9 wt %, but more preferably they are used at greater than 1 wt %, even greater than 2 wt % and most preferably greater than 3 wt %, even more preferably greater than 5 wt %, say 6 to 8 wt % in the composition.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from, about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

Suitable soil release polymers are described in WO 2008095626 (Clariant); WO 2006133867 (Clariant); WO 2006133868 (Clariant); WO 2005097959 (Clariant); WO 9858044 (Clariant); WO 2000004120 (Rhodia Chimie); U.S. Pat. No. 6,242,404 (Rhodia Inc); WO 2001023515 (Rhodia Inc); WO 9941346 (Rhodia Chim); WO 9815346 (Rhodia Inc); WO 9741197 (BASF); EP 728795 (BASF); U.S. Pat. No. 5,008,032 (BASF); WO 2002077068 (BASF); EP 483606 (BASF); EP 442101 (BASF); WO 3820092 (Proctor & Gamble); EP 201124 (Proctor & Gamble); EP 199403 (Proctor & Gamble); DE 2527793 (Proctor & Gamble); WO 9919429 (Proctor & Gamble); WO 9859030 (Proctor & Gamble); U.S. Pat. No. 5,834,412 (Proctor & Gamble); WO 9742285 (Proctor & Gamble); WO 9708162 (Proctor & Gamble); WO 9502030 (Proctor & Gamble); WO 9502028 (Proctor & Gamble); EP 357280 (Proctor & Gamble); U.S. Pat. No. 4,116,885 (Proctor & Gamble); WO 9532232 (Henkel); WO 9532232 (Henkel); WO 9616150 (Henkel); WO 9518207 (Henkel); EP 1099748 (Henkel); FR 2619393 (Colgate Palmolive); DE 3411941 (Colgate Palmolive); DE 3410810 (Colgate Palmolive); WO 2002018474 (RWE-DEA MINERALOEL & CHSM AG; SASOL GERMANY GMBH); EP 743358 (Textil Color AG); PL 148326 (Instytut Ciezkiej Syntezy Organicznej "Blachownia", Pol.); JP 2001181692 (Lion Corp); JP 11193397 A (Lion Corp); RO 114357 (S.C. "Prod Cresus" S.A., Bacau, Rom.); and U.S. Pat. No. 7,119,056 (Sasol).

Particularly preferred are combinations of relatively high-levels of EPEI (>5 wt % on the composition) with soil release polymers, especially, but not exclusively, if betaine is included in the surfactant system.

We have determined that combination of EPEI and soil release polymers of the above types enables increased performance at lower surfactant levels compared to 1.0 g/L or higher non soap surfactant wash liquors with betaine but without either EPEI or SRP. This effect is particularly visible on a range of stains on polyester, most particularly red clay. The effect of the combination on sunflower oil and foundation is also beneficial. SRP performance is enhanced significantly by repeated pre-treatment. There is some evidence of a build-up effect of EPEI performance.

The most preferred soil release polymers are the water soluble/miscible or dispersible polyesters such as: linear polyesters sold under the Repel-O-Tex brand by Rhodia (gerol), lightly branched polyesters sold under the Texcare brand by Clariant, especially Texcare SRN170, and heavily branched polyesters such as those available from Sasol and described in U.S. Pat. No. 7,119,056.

Enzymes:

One or more enzymes may be present in a composition of the invention and when practicing a method of the invention.

Lipase:

As noted above, suitable lipases include those of bacterial or fungal origin. Chemically modified or protein engineered mutants are included. Examples of useful lipases include lipases from *Humicola* (synonym *Thermomyces*), e.g. from *H. lanuginosa* (*T. lanuginosus*) as described in EP 258 068 and EP 305 216 or from *H. insolens* as described in WO 96/13580, a *Pseudomonas* lipase, e.g. from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), a *Bacillus* lipase, e.g. from *B. subtilis* (Dartois et al. (1993), Biochemica et Biophysics Acta, 1131, 253-360), *B. stearothermophilus* (JP 64/744992) or *B. pumilus* (WO 91/16422). As noted above the preferred ones have a high degree of homology with the wild-type lipase derived from *Humicola lanuginose.*

Other examples are lipase variants such as those described in WO 92/05249, WO 94/01541, HP 407 225, EP 260 105, WO 95/35381, WO 96/00292, WO 95/30744, WO 94/25578, WO 95/14783, WO 95/22615, WO 97/04079 and WO 97/07202.

Preferred commercially available lipase enzymes include Lipolase™ and Lipolase Ultra™, Lipex™ and Lipoclean™ (Novozymes A/S).

In addition to or as an alternative to lipase one or more other enzymes may be present. However lipase is particularly preferred.

Advantageously, the presence of relatively high levels of calcium in the poorly built or unbuilt compositions of the invention has a beneficial effect on the turnover of certain enzymes, particularly lipase enzymes and preferably lipases from *Humicola.*

The preferred lipases include first wash lipases which comprise a polypeptide having an amino acid sequence which has at least 90% sequence identity with the wild-type lipase derived from *Humicola lanuginosa* strain DSM 4109 and compared to card wild-type lipase, comprises a substitution of an electrically neutral or negatively charged amino acid within 15 A of E1 or Q249 with a positively charged amino acid; and may further comprise:

(I) a peptide addition at the C-terminal;

(II) a peptide addition at the N-terminal;

(III) meets the following limitations:

i. comprises a negatively charged amino acid in position E210 of said wild-type lipase;

ii. comprises a negatively charged amino acid in the region corresponding to positions 90-101 of said wild-type lipase; and iii. comprises a neutral or negatively charged amino acid at a position corresponding to N94 of said wild-type lipase; and/or iv. has a negative charge or neutral charge in the region corresponding to positions 90-101 of said wild-type lipase; and (IV) mixture thereof.

These are available under the Lipex™ brand from Novozymes. A similar enzyme from Novozymes but believed to fall outside of the above definition is sold by Novozymes under the name Lipoclean™ and this is also preferred.

Phospholipase:

The method of the invention may be carried out in the presence of phospholipase classified as EC 3.1.1.4 and/or EC 3.1.1.32. As used herein, the term phospholipase is an enzyme which has activity towards phospholipids. Phospholipids, such as lecithin or phosphatidylcholine, consist of glycerol esterified with two fatty acids in an outer (sn-1) and the middle (sn-2) positions and esterified with phosphoric acid in the third position; the phosphoric acid, in turn, may be esterified to an amino-alcohol. Phospholipases are enzymes which participate in the hydrolysis of phospholipids. Several types of phospholipase activity can be distinguished, including phospholipases $A_1$ and $A_2$ which hydrolyze one fatty acyl group (in the sn-1 and sn-2 position, respectively) to form lysophospholipid; and lysophospholipase (or phospholipase B) which can hydrolyze the remaining fatty acyl group in lysophospholipid. Phospholipase C and phospholipase D (phosphodiesterases) release diacyl glycerol or phosphatidic acid respectively.

Protease:

Suitable proteases include those of animal, vegetable or microbial origin. Microbial origin is preferred. Chemically modified or protein engineered mutants are included. The protease may be a serine protease or a metallo protease, preferably an alkaline microbial protease or a trypsin-like protease. Preferred commercially available protease enzymes include Alcalase™, Savinase™, Primase™, Duralase™, Dyrazym™, Esperase™, Everlase™, Polarzyme™, and Kannase™, (Novozymes A/S), Maxatase™, Maxacal™, Maxapem™, Properase™, Purafect™, Purafect OxP™, FN2™, and FN3™ (Genencor International Inc.).

Cutinase:

The method of the invention may be carried oat in the presence of cutinase, classified in EC 3.1.1.74. The cutinase used according to the invention may be of any origin. Preferably cutinases are of microbial origin, in particular of bacterial, of fungal or of yeast origin.

Amylase:

Suitable amylases (alpha and/or beta) include those of bacterial or fungal origin. Chemically modified or protein engineered mutants are included. Amylases include, for example, alpha-amylases obtained from *Bacillus*, e.g. a special strain of *B. licheniformis*, described in more detail in GB 1,296,839, or the *Bacillus* sp, strains disclosed in WO 95/026397 or WO 00/060060. Commercially available amylases are Duramyl™, Termamyl™, Termamyl Ultra™, Natalase™, Stainzyme™, Fungamyl™ and BAN™ (Novozymes A/S), Rapidase™ and Purastar™ (from Genencor International, Inc.).

Cellulase:

Suitable cellulases include those of bacterial or fungal origin. Chemically modified or protein engineered mutants are included. Suitable cellulases includes cellulases from the genera *Bacillus, Pseudomonas, Humicola, Fusarium, Thielavia, Acremonium*, e.g. the fungal cellulases produced from *Humicola insolena, Thielavia terrestris, Myceliophthora thermophila*, and *Fusarium oxysporum* disclosed in U.S. Pat. No. 4,435,307, U.S. Pat. No. 5,648,263, U.S. Pat. No. 5,691,178, U.S. Pat. No. 5,776,757, WO 89/09259, WO 96/029397, and WO 98/012307. Commercially available cellulases include Celluzyme™, Carezyme™, Endolase™, Renozyme™ (Novozymes A/S), Clazinase™ and Puradex HA™ (Genencor International Inc.), and KAC-500(B)™ Kao Corporation).

Peroxidases/Oxidases:

Suitable peroxidases/oxidases include those of plant, bacterial or fungal origin. Chemically modified or protein engineered mutants are included. Examples of useful peroxidases include peroxidases from *Coprinus*, e.g. from *C. cinereus*, and variants thereof as those described in WO 93/24618, WO 95/10602, and WO 98/15257. Commercially available peroxidases include Guardzyme™ and Novozym™ 51004 (Novozymes A/S).

Pectate Lyases:

Pectate lyases (also called polygalacturonate lyases): Examples of pectate lyases include pectate lyases that have been cloned from different bacterial genera such as *Erwinia, Pseudomonas, Klebsiella* and *Xanthomonas*, as well as from *Bacillus subtilis* (Nasser et al. (1993) FEBS Letts. 335:319-326) and *Bacillus* sp. YA-14 (Kim et al. (1994) Biosci. Biotech. Biochem. 58:947-949). Purification of pectate lyases with maximum activity in the pH range of 8-10 produced by *Bacillus pumilus* (Dave and Vaughn (1971) J. Bacteriol. 108: 166-174), *B. polymyxa* (Nagel and Vaughn (1961) Arch. Biochem. Biophys. 93:344-352), *B. stearothermophilus* (Karbassi and Vaughn (1980) Can. J. Microbiol. 26:377-384), *Bacillus* sp. (Hasegawa and Nagel (1966) J. Food Sol. 31:838-845) and *Bacillus* sp. RK9 (Kelly and Fogarty (1978) Can. J. Microbiol, 24:1164-1172) have also been described. Any of the above, as well as divalent cation-independent and/or thermostable pectate lyases, may be used in practicing the invention. In preferred embodiments, she pectate lyase comprises the pectate lyase disclosed in Heffron et al., (1995) Mol. Plant-Microbe Interact. 8: 331-334 and Henrissat et al., (1995) Plant Physiol. 107: 968-976. Specifically contemplated pectatel lyases are disclosed in WO 99/27083 and WO 99/27084. Other specifically contemplated pectate lyases (derived from *Bacillus licheniformis*) are disclosed in U.S. Pat. No. 6,284,524 (which document is hereby incorporated by reference). Specifically contemplated pectate lyase variants are disclosed in WO 02/006442, especially the variants disclosed in she Examples in WO 02/006442 (which document is hereby incorporated by reference).

Examples of commercially available alkaline pectate lyases include BIOPREP™ and SCOURZYME™ L from Novozymes A/S, Denmark.

Mannanases:

Mannanase: Examples of mannanases (EC 3.2.1.78) include mannanases of bacterial and fungal origin. In a specific embodiment the mannanase is derived from a strain of the filamentous fungus genus *Aspergillus*, preferably *Aspergillus niger* or *Aspergillus aculeatus* (WO 94/25576). WO 93/24622 discloses a mannanase isolated from *Trichoderma reseei*. Mannanases have also been isolated from several bacteria, including *Bacillus* organisms. For example, Talbot et al., Appl. Environ. Microbiol., Vol. 56, No. 11, pp. 3503-3510 (1990) describes a beta-mannanase derived from *Bacillus* stearothermophilus. Mendoza et al. World J. Microbiol. Biotech., Vol. 10, No, 5, pp. 551-555 (1994) describes a beta-mannanase derived from *Bacillus subtilis*. JP-A-03047076 discloses a beta-mannanase derived from *Bacillus* sp. JP-A-63056289 describes the production of an alkaline, thermostable beta-mannanase. JP-A-63036775 relates to the *Bacillus* microorganism FERM P-8856 which produces beta-mannanase and beta-mannosidase. JP-A-08051975 discloses alkaline beta-mannanases from alkalophilic *Bacillus* sp. AM-001. A purified mannanase from *Bacillus amyloliquefaciens* is disclosed in WO 97/11164. WO 91/18974 describes a hemicellulase such as a glucanase, xylanase or mannanase active. Contemplated are the alkaline family 5 and 26 mannanases derived from *Bacillus agaradhaerens, Bacillus licheniformis, Bacillus halodurans, Bacillus clausii, Bacillus* sp., and *Humicola insolens* disclosed in WO 99/64619. Especially contemplated are the *Bacillus* sp. mannanases concerned in the Examples in WO 99/64619.

Examples of commercially available mannanases include Mannaway™ available from Novozymes A/S Denmark. The enzyme and any perfume/fragrance or pro-fragrance present may show some interaction and should be chosen such that this interaction is not negative. Some negative interactions may be avoided by encapsulation of one or other of enzyme and pro-fragrance and/or other segregation within the product.

Enzyme Stabilizers:

Any enzyme present in the composition may be stabilized using conventional stabilizing agents, e.g., a polyol such as propylene glycol or glycerol, a sugar or sugar alcohol, lactic acid, boric acid, or a boric acid derivative, e.g., an aromatic borate ester, or a phenyl boronic acid derivative such as 4-formylphenyl boronic acid, and the composition may be formulated as described in e.g. WO 92/19709 and WO 92/19708.

Bleach Catalyst:

Detergent compositions according to the invention may comprise a bleach system.

The present invention may be used in a formulation that is used to bleach via air, or an air bleach catalyst system. Suitable complexes and organic molecule (ligand) precursors for forming complexes are available to the skilled worker, for example, from: WO 98/39098; WO 98/39406, WO 97/48787, WO 00/29537; WO 00/52124, and WO00/60045, incorporated by reference. An example of a preferred catalyst is a transition metal complex of MeN4Py ligand (N,N-bis(pyridin-2-yl-methyl)-1-,1-bis(pyridin-2-yl)-1-aminoethane).

Suitable bispidon catalyst materials and their action are described in WO02/48301.

Photobleaches may also be employed. In the context of the present invention a "photobleach" is any chemical species that forms a reactive bleaching species on exposure to sunlight, and preferably is not permanently consumed in the reaction. Preferred photo-bleaches include singlet oxygen photo-bleaches and radical photo-bleaches. Suitable singlet oxygen photo-bleaches may be selected from, water soluble phthalocyanine compounds, particularly metallated phthalocyanine compounds where the metal is Zn or Al—Z1 where Z1 is a halide, sulphate, nitrate, carboxylase, alkanolate or hydroxyl ion. Preferably the phthalocyanin has 1-4 $SO_3X$ groups covalently bonded to it where X is an alkali metal or ammonium ion. Such compounds are described in WO2005/014763' (Ciba).

When present, she bleach catalyst is typically incorporated at a level of about 0.0001 to about 10 wt %, preferably about 0.001 to about 5 wt %.

Perfume

Given that the method of the present invention preferably used very low levels of product dosage, it is advantageous to ensure that perfume is employed efficiently.

A particularly preferred way of ensuring that perfume is employed efficiently is to use an encapsulated perfume. Use of a perfume that is encapsulated reduces the amount of perfume vapour that is produced by the composition before it is diluted. This is important when the perfume concentration is increased to allow the amount of perfume per wash to be kept at a reasonably high level.

It is even more preferable that the perfume is not only encapsulated but also that the encapsulated perfume is provided with a deposition aid to increase the efficiency of perfume deposition and retention on fabrics. The deposition aid is preferably attached to the encapsulate by means of a covalent bond, entanglement or strong adsorption, preferably by a covalent bond or entanglement.

Deposition Aids

Both for the efficient deposition of perfume, e.g. encapsulated perfume, and for the deposition of other benefit agents, such as silicone it is desirable to use a deposition aid in the composition. An especially preferred class of deposition aids includes those which are substantive to cellulose.

In one preferred embodiment, the deposition aid is a polysaccharide. In preferred embodiments the polysaccharide is a β-1,4-linked backbone and is substantive to cellulose. Preferably the polysaccharide is a cellulose, a cellulose derivative, or another β-1,4-linked polysaccharide having an affinity for cellulose, such as polymannan, polyglucan, polyglucomannan, polyxyloglucan and polygalactomannan or a mixture thereof. More preferably, the polysaccharide is selected from the group consisting of polyxyloglucan and polygalactomannan. Particularly preferred polysaccharides are locust bean gum, tamarind xyloglucan, guar gum or mixtures thereof. Moss preferably, the deposition aid is locust bean gum.

Cationic polymer can also be used as deposition aids. Examples of such cationic polymers used as coatings are cationically modified starch and cationically modified guar, polymers comprising poly diallyl dimethyl ammonium halides (PolyDADMAC), and copolymers of DADMAC with vinyl pyrrolidone, acrylamides, imidazoles, imidazolinium halides, and the like. For instance, Polyquarternium-6, 7, 22 and 39, all available from Ondeo Nalco. Cationic polysaccharides are preferred. Particularly preferred cationic starches have a molecular weight of from about 100,000 to about 500,000,000, preferably from about 200,000 to about 10,000,000 and most preferably from about 250,000 to about 5,000,000. Particularly preferred cationic starch products are HI-CAT CWS42 and HI-CAT 02 and are commercially available from ROQUETTE AMERICA, Inc. Preferred cationic guars have a molecular weight of from about 50,000 to about 0.5,000,000. Suitable cationic polymeric deposition aids include cationic guar polymers such as Jaguar (ex Rhone Poulenc), cationic cellulose derivatives such as Celquats (ex National Starch), Flocaid (ex National Starch), cationic potato starch such as SoftGel (ex Aralose), cationic polyacrylamides such as PCG (ex Allied Colloids). The preferred cationic guars are Jaguar C-162 and Jaguar C-17 and are commercially available from Rhodia Inc.

Alternative preferred deposition aids are those which are substantive to polyester. Preferably, the polyester-substantive deposition aid is a polymer derivable from dicarboxylic acids and polyols, particularly a phthalate containing polymer, more preferably a polymer comprising units derived from (poly)ethylene glycol and terephthalate. Most preferably the polymer is a selected from the group comprising PET/POET, PEG/POET, PET/PEG and phthalate/glycerol/ethylene glycol polymers. Materials of this type are widely available to the laundry formulator as they are commonly used as soil-release polymers (as discussed above). Given the more efficient deposition of certain benefit ingredients from the compositions of the present invention it is possible to deliver more expensive benefit agents than would otherwise be economic, these can include materials having a benefit other than a pleasant odour, such as an aromatherapeutic benefit.

Further Optional Ingredients:

The compositions of the invention may contain one or more other ingredients. Such ingredients include viscosity modifiers, preservatives (e.g. bactericides), pH buffering agents, hydrotropes, polyelectrolytes, anti-shrinking agents, anti-wrinkle agents, anti-oxidants, sunscreens, anti-corrosion agents, drape imparting agents, anti-static agents and ironing aids. The products of the invention can contain pearlisers and/or opacifiers.

The detergent compositions herein may also optionally contain relatively low levels of organic detergent builder material. Examples include the alkali metal, citrates, succinates, malonates, carboxymethyl succinates, carboxylates, polycarboxylates and polyacetyl carboxylates. Specific examples include sodium, potassium and lithium salts of oxydisoccinic acid, mellitic acid, benzene polycarboxylic acids, $C_{10}$-$C_{22}$ fatty acids and citric acid. Other examples are DEQUEST™, organic phosphonate type sequestering agents sold by Monsanto and alkanehydroxy phosphonates. Citrate salts and $C_{12}$-$C_{18}$ fatty acid soaps are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the name SOKALAN™.

If utilized, the organic builder materials may comprise from about 0.5% to 20 wt %, preferably from 1 wt % to 10 wt %, of the composition. The preferred builder level (other than soaps) is less and 10 wt % and preferably less than 5 wt % of the composition. Given that the surfactants of the invention are preferably selected to be calcium tolerant, overall builder levels of less than 10 wt % (including any soaps) are preferred, as this not only reduces the quantity of product required per wash but also maintains a level of calcium which assists in the activity of certain enzymes. Such low builder (or zero builder) levels are also useful when pre-softened water is used for the dilution step.

Two ingredients that are very much preferred to be present in compositions according to the invention are buffers and hydrotropes.

Buffers

The presence of some buffer is preferred for the Lipase performance (or at least pH control), because it is desirable for alkaline pH to be maintained and if the lipase hydrolyses fatty soils to fatty acids then it can be expected for the pH to drop unless buffer is present. Preferred buffers are borax, MEA, and TEA. They are used in the composition at levels of from 5 to 15 wt %.

Hydrotropes

Preferred liquids will comprise some hydrotrope, although the minimum amount consistent with the need for concentration should be used. Suitable hydrotropes include MPG (monopropylene glycol). This and/or other conventionally employed hydrotropes may be used in the composition at levels of from 2 to 10 wt %.

EXAMPLES

Example 1

Calcium Tolerant Surfactant Blends

The surfactant blends listed in Table 1a were prepared at a concentration of 0.7 g/l in water containing sufficient Calcium ions to give a French Hardness of 40 degrees. Following the method disclosed in EP1771543 other electrolytes such as sodium chloride, sodium sulphate, sodium hydroxide were added as necessary to adjust the ionic strength to 0.5M and the pH to 10. The absorption of light of wavelength 540 nm through 4 min of sample was measured 15 minutes after sample preparation. Ten measurements are made and an average value is calculated. Samples that give an absorption value of less than 0.08 are deemed to be calcium, tolerant.

TABLE 1a

| Sample | Ratio | Adsorbance | Pass/Fail |
|---|---|---|---|
| LAS | 100 | 0.267 | Fail |
| LAS/AE-7EO | 90/10 | 0.218 | Fail |
| LAS/AE-7EO | 60/40 | 0.044 | Pass |
| LAS/AE-30EO | 90/10 | 0.061 | Pass |
| LAS/AE-30EO | 60/40 | 0.038 | Pass |
| LAS/APG | 80/20 | 0.474 | Fail |
| LAS/AES-1EO | 90/10 | 0.140 | Fail |
| LAS/AES-3EO | 90/10 | 0.072 | Pass |
| APG | 100 | 0.056 | Pass |
| AES-3EO | 100 | 0.048 | Pass |
| AE-7EO | 100 | 0.045 | Pass |
| LAS/Sulphobetaine | 95/5 | 0.033 | Pass |

TABLE 1b materials listed in Table 1a

| Material | Grade | Supplier |
|---|---|---|
| LAS | NANSA HS90PF | Huntsman |
| AE-7EO | Neodol 25-7 | Shell |
| AE-30EO | Lutensol AO30 | BASF |
| APG | Glucopon 50G | Cognis |
| Sulfobetaine | Ralufon DCH | Raschig |
| AES-3EO | Empicol ESC 70 | Huntsman |
| AES-1EO | Empicol ESA 70 | Huntsman |

From the results it can be seen that pure LAS is insufficiently calcium tolerant, whereas pure alkyl poly glucoside (APG), the alkyl ether sulphate (AES-3EO) and the alcohol ethoxylate (AE-7EO) were calcium tolerant. The addition of zwitterionic (sulphobetaine), AE-7EO or AE-30EO rendered the LAS based surfactant systems calcium tolerant, although more of the 7EO material needed to be added than the 30EO material.

Examples 2-5

Fully Formulated Compositions

Each of the examples detailed in Table 2a and 2b was used to wash a range of stained and soiled fabrics, which had been attached to a piece of ballast fabric. Apart from the control, each of the compositions had the same non-soap surfactant level. All of the compositions and the control, comprised the ingredients listed in Table 2a with the differences between the examples being as indicated in Table 2b.

The washes were conducted in a European Miele washing machine using its standard 40° C. cotton wash cycle. The main wash intake was 15 l of ambient temperature water of 26°FH water (Ca:Mg 3:1) and the total wash time (including rinses) was 1 hour 56 mins. A mixed ballast load of 3 kg (40% woven polycotton, 30% woven cotton, 30% knitted cotton) was also included in each cycle to better mimic real wash use conditions. Examples 2 to 5 were dosed at a total product volume of 20 ml/wash, whilst the control used was (Persil "Small and Mighty"™) it was dosed at 35 ml/wash, as per manufacturer's recommendation. Its already higher composition level of non-soap surfactant coupled with this higher dosing volume accounts for the large difference in non-soap surfactant concentration in the wash liquors of the examples versus the control. Apart from the surfactant levels and the other ingredient differences specified in table 2b the control wash liquor made by dilution of the 35 ml aliquot of Persil Small and Mighty™ would have had the same levels of ingredients from table 2a as the wash liquors that would have been made by dilution of 20 ml aliquots of examples 2 to 5. The 20 ml example doses weighed 21 g; The 35 ml control example dose weighed 37 g.

TABLE 2a

Fixed compositions (parts active):

| Material | Function | Source | Level |
|---|---|---|---|
| Glycerol | Solvent | Univar | 3.17 |
| MPG | Hydrotrope | Dow | 5.7 |
| NaOH | | | 2.13 |
| TEA | Buffer | Univar | 2.05 |
| Neodol 25-7 | Alcohol ethoxylate non-soap surfactant | Surfachem | 12.74 |
| F-Dye | Fluorescer | | 0.18 |
| Citric Acid | Builder | | 1.71 |
| LAS (as LAS Acid) | Non-soap surfactant precursor | Lever Faberge | 8.49 |
| Fatty acid | Soap surfactant precursor | Uniqema | 3.03 |
| SLES | Non-soap surfactant | Lever Faberge | 4.24 |
| Dequest 2066 | Sequestrant | Thermophos | 0.875 |
| Patent Blue | Colouring | Sensient | 0.00036 |
| Acid Yellow | Colouring | Sensient | 0.00005 |
| Opacifier | | Rohm Haas | 0.0512 |
| Perfume | Fragrance | IFF | 0.734 |
| Savinase | Enzyme | Novozymes | 2.362 |
| Stainzyme | Enzyme | Novozymes | 0.945 |

TABLE 2a variable compositions (parts active):

| | Ex. 2 | Ex. 3 | Ex. 4 | Ex. 5 |
|---|---|---|---|---|
| EPEI | 5.5 | 5.5 | 5.5 | 9 |
| Lipex | 3 | 3 | 3 | 3 |
| Texcare SRN170 | 0 | 7.5 | 0 | 0 |
| Sokolan CP5 | 0 | 0 | 20 | 0 |
| Borax | 10 | 10 | 10 | 10 |
| Empigen BB | 1.5 | 1.5 | 1.5 | 1.5 |
| TOTAL Non-Soap Surfactant | 26.345 | 26.345 | 26.345 | 26.345 |

Notes on Ingredients in Table 2b

| Ingredient | Information | Supplier |
|---|---|---|
| Borax | Buffer | Sigma |
| EPEI | Polymer EPEI 20EO: polyethyleneimine having a weight average molecular weight of about 600 and wherein the polyethyleneimine has been modified by alkoxylation with on average 20 ethylene oxide moieties | Nippon Shokubai |
| Lipex | Lipase enzyme including stabilization system. Active lipase protein level is 100 000 LU/g | Novozymes |
| Texcare SRN170 | Soil release polymer | Clariant |
| Sokolan CP5 | Soil release polymer | BASF |
| Empigen BB | Non-soap surfactant (Betaine) | Huntsman |

The performance of the compositions of Examples 2 to 5 were determined to be as follows:

- for some stains and soils, equivalent performance was obtained to that of the control (35 ml dose).
- surprisingly, for other stains and soils, a selection shown in Table 3, enhanced performance was achieved despite the amount of product dosed and overall in-wash surfactant level being much reduced compared to that of the control.

TABLE 3

Stain Removal Performance (in wash non-soap surfactant level of 0.37 g/l) relative to Control (in wash non-soap surfactant level of 1.02 g/l)

| | Performance Relative to Control* | | | |
|---|---|---|---|---|
| Stain or soil | Ex. 2 | Ex. 3 | Ex. 4 | Ex. 5 |
| Red pottery clay on polyester | Better | Better | Better | Better |
| Yellow pottery clay on polyester | Better | Better | Better | Same |
| Blood on Cotton | Better | — | Better | Same |
| Dirty Motor Oil on polyester | Better | Better | Better | Same |
| Lard (Dyed) on polyester | Same | Same | Same | Same |

*Under equivalent wash conditions, in wash non-soap surfactant level for Control = 1.02 g/l

Examples 6 to 9 and A and B

Improved Delivery of Shading Dye from 5× Compositions

In order to assess the shading dye delivery from compositions within the scope of the invention, six formulations were compared. These are given in Table 4

Examples of a conventional concentrated detergent liquid with and without, shading dye (A and B) are compared to formulations 1-4 which are all embodiments of the invention.

TABLE 4

| % of composition | A | B | 6 | 7 | 8 | 9 |
|---|---|---|---|---|---|---|
| LAS (as LAS Acid) | 13.4 | 13.4 | 8.49 | 8.49 | 8.49 | 8.49 |
| Neodol 25-7 | 20.11 | 20.11 | 12.74 | 12.74 | 12.74 | 12.74 |
| Fatty acid | 4.78 | 3.03 | 3.03 | 3.03 | 3.03 | 3.03 |
| SLES | 6.7 | 6.7 | 4.24 | 4.24 | 4.24 | 4.24 |
| PEI(600)20EO | 0 | 0 | 0 | 0 | 5.5 | 5.5 |
| Direct Violet 9 | 0 | 0.02 | 0 | 0.035 | 0 | 0.035 |
| Water and buffer* | Balance to 100% | | | | | |

*sufficient 5 mM Tris buffer to give a diluted pH of 8

Appropriate dosages of the formulations were added to each terg-o-tometer pot to deliver the ingredient levels given in table 5. The pots contained each contained 980 ml water with sufficient hardness ions to achieve a water hardness of 6°FH (Ca:Mg=2:1).

TABLE 5

| Delivered ingredient levels (in g/l) | A | B | 6 | 7 | 8 | 9 |
|---|---|---|---|---|---|---|
| Surfactant | 1.1 | 1.1 | 0.4 | 0.4 | 0.4 | 0.4 |
| Direct Violet 9 | 0 | 0.000466 | 0 | 0.000466 | 0 | 0.000466 |
| PEI(600)20EO | 0 | 0 | 0 | 0 | 0.073 | 0.073 |

Sufficient pieces of cotton, interlock (7.5 cm×7.5 cm) were added to each, pot to achieve a liquor to cloth ratio of 30:1. The experiment was run at 25° C.

After washing and drying, the reflectance of samples of the cotton interlock pieces were determined using a reflectometer. These results are shown in Table 6 and are expressed in terms of a L* (Lightness) value (as defined by the CIE 1976 (L*, a*, b*) color space).

TABLE 6

| Formulation | Significance* | L* |
|---|---|---|
| A | X | 95.5 |
| 8 | X | 95.4 |
| 6 | X | 95.4 |
| B | Y | 90.9 |
| 7 | Z | 90.6 |
| 9 | Z | 90.6 |

*formulations joined by the same letter show no significant difference at the 95% confidence level.

In all cases addition of shading dye causes a reduction in Lightness value. The reduction is significantly greater for embodiments of the current invention, i.e. formulations 7 and 9. It can therefore be concluded that there is better deposition of shading dye when it is used according to the invention.

Examples 10 to 13 (Comparative C to F)

Synergies Between EPEI and Betaine at Low in Wash Surfactant Concentrations

Surfactant compositions shown in table 7 were tested in a Linitest with and without either betaine or EPEI (PEI600 20EO) and using the method described below.

TABLE 7

(all values expressed as wt %)

| | Base | Base + Betaine |
|---|---|---|
| NaLAS | 34.0 | 30.3 |
| Prifac 5908 | 10.6 | 9.5 |
| Neodol 25-7 | 40.4 | 40.4 |
| SLES 3EO | 14.9 | 13.2 |
| Empigen BB (betaine) | 0 | 6.6 |

The Linitest pots were filled with 6°FH water (2:1 Ca2+:Mg2+) and then the required surfactant and polymer solutions such that the final wash liquor volume was 100 ml. Using either 0.1M NaOH or 0.1M HCl the wash liquor pH was adjusted to 7. To each Lintiest pot 2 woven cotton and 2 knitted polyester yellow pottery clay stains plus 4 ballast cloths (2 cotton and 2 knitted polyester) were then added with liquor to cloth ratios of 8:1. Finally, fifty metal ball bearings were added before closing the Linitest pot and washing the cloths for 15 minutes at 25° C. and 100 rpm.

After the wash was completed the ball bearing were removed, the cloths were squeezed to remove excess liquor and then rinsed within the Linitest pot twice for 3 minutes (at 100 rpm) in two portions of 200 ml 6°FH water. Finally the cloths were wrung out and allowed to dry on racks at room temperature.

The colour of she stains was measured both before and after-washing on a Hunter lab reflectometer and expressed in terms of the difference between the stain and clean cloth giving ΔE*before wash or ΔE*after wash values respectively. The ΔE values are colour differences defined as the Euclidian distance between the stain and clean cloth in L*a*b* colour space.

At 1 g/L non-soap surfactant, yellow pottery clay from knitted polyester.

| | SRI | ΔE |
|---|---|---|
| Eg C Base | 88.8 | 11.2 |
| Eg D Base + 50 ppm EPEI | 91.2 | 8.8 |
| Eg E Base + betaine | 90.6 | 9.4 |
| Eg F Base + betaine + 50 ppm EPEI | 96.5 | 3.5 |

At 0.5 g/L non-soap surfactant, yellow pottery clay from knitted polyester

| | | SRI | E |
|---|---|---|---|
| Eg 10 | Base | 88.1 | 11.9 |
| Eg 11 | Base + 25 ppm EPEI | 91.6 | 8.4 |
| Eg 12 | Base + betaine | 88.0 | 12.0 |
| Eg 13 | Base + betaine + 25 ppm EPEI | 92.3 | 7.7 |

Two effects can be seen from these tests.

First it can be seen that at the lower non-soap surfactant levels the effect of the EPEI is greater. In fact half the amount gives a larger effect on ΔE (Eg 10, 11.9 to Eg 11, 8.4 versus Comparative Eg C, 11.2 to Comparative Eg D, 8.8).

Second it can be seen that the further boost is obtained with a combination of betaine and EPEI, especially at low non-soap surfactant levels. At the high non-soap surfactant levels the addition of betaine has an effect on its own (11.2 to 9.4) whereas at the lower in wash non-soap surfactant levels there is no discernable effect from adding the betaine and only when the EPEI is also added in Eg 13 does the ΔE further improve.

Thus addition of EPEI is more effective at lower in wash non-soap surfactant levels for this type of soil and EPEI is even more effective at low non-soap surfactant concentrations if it is used with betaine as part of the surfactant system.

Examples 14 to 20 (G and H)

EPEI at Various Surfactant Concentrations

For these examples the composition used was as detailed below. No other ingredients were used.

| | |
|---|---|
| 19.11% | NI, 7EO |
| 12.73% | LAS acid |
| 6.37% | SLES |
| 4.54% | Fatty acid |
| 2.25% | Betaine |

Test pieces were subjected to a 15 minute wash in linitest with a liquor to cloth ratio of 8:1 at a temperature of 25° C. The water hardness used was 6°FH (2:1 Ca:Mg). The wash was followed by two 3 minute rinses in the linitest. Key Marker stain for EPEI performance is Red Pottery clay on knitted polyester.

G—control, 1.2 g/l non-soap surfactant
14—0.24 g/l non-soap surfactant
15—0.4 g/l non-soap surfactant
16—0.24 g/l non-soap surfactant+0.067 g/l EPEI
17—0.4 g/l non-soap surfactant+0.067 g/l EPEI

TABLE 8

| | | | | |
|---|---|---|---|---|
| 17 | X | | | 77.4 |
| 16 | X | Y | | 75.5 |
| G | X | Y | Z | 73.8 |
| 15 | | Y | Z | 72.3 |
| 14 | | | Z | 71.2 |

At the 95% Confidence level there is a significant benefit of removal of red pottery clay from addition of EPEI over surfactant alone. This shows the boost to the performance of the low surfactant formulation versus the control by adding EPEI.

Further examples were carried out following the same protocol as first set.

Key:
H—control, 1.2 g/l non-soap surfactant
18—0.33 g/l non-soap surfactant
19—0.33 g/l non-soap surfactant+0.11 g/l EPEI
20—0.33 g/l non-soap surfactant+0.17 g/l EPEI

TABLE 9

| | | | |
|---|---|---|---|
| 20 | X | | 88.4 |
| 19 | X | | 85.9 |
| H | | Y | 75.0 |
| 18 | | Y | 72.0 |

Increased reflectance due to removal.

This confirms chat at the 95% Confidence level there is a significant benefit in increased reflectance die to removal of red pottery clay for addition of EPEI over surfactant alone at the low in wash non-soap surfactant levels.

Examples 21 to 26 EPEI with SRP

The aim of these examples was to determine the effect of replacing lipex with Texcare SRN170 soil release polymer on primary detergency of knitted cotton. It is known that knitted cotton is more responsive to liquid detergents than woven cotton. As well as this, the performance of lipolase, a multi-wash lipase, was tested as an alternative to lipex, which is a single wash lipase. Also formulations combining EPEI, lipase and SRP. All formulations except the 35 ml control, contained carbobetaine and EPEI at 1.5% and 5.5% respectively. All formulations except the control 35 ml formulation were buffered and so had an in-wash pH of around 8.5.

The wash conditions used were European FLA Washing Machines with normal 40° C. Cotton Wash Cycle. 3 kg of mixed standard ballast was included in the 15 Liter fill. The monitors comprised stains on knitted cotton and knitted polyester, together with Lard on blue knitted cotton.

TABLE 10

| | Eg 21 30% active + Lipex | Eg 22 30% active + EPEI + Lipex | Eg 23 30% active + EPEI + lipolase | Eg 24 30% active + EPEI + SRP | Eg 25 30% active + EPEI + Lipex + SRP | Eg 26 30% active + EPEI + lipolase + SRP |
|---|---|---|---|---|---|---|
| Glycerol | 3.17 | 3.17 | 3.17 | 3.17 | 3.17 | 3.17 |
| MPG | 5.7 | 5.7 | 5.7 | 5.7 | 5.7 | 5.7 |
| NaOH | 2.13 | 2.13 | 2.13 | 2.13 | 2.13 | 2.13 |
| TEA | 2.05 | 2.05 | 2.05 | 2.05 | 2.05 | 2.05 |
| Neodol 7EO | 12.74 | 12.74 | 12.74 | 12.74 | 12.74 | 12.74 |
| F dye | 0.18 | 0.18 | 0.18 | 0.18 | 0.18 | 0.18 |
| Citric acid | 1.71 | 1.71 | 1.71 | 1.71 | 1.71 | 1.71 |
| LAS | 8.49 | 8.49 | 8.49 | 8.49 | 8.49 | 8.49 |
| Fatty acid | 3.03 | 3.03 | 3.03 | 3.03 | 3.03 | 3.03 |
| Betaine | 1.5 | 1.5 | 1.5 | 1.5 | 1.5 | 1.5 |
| SLES | 4.24 | 4.24 | 4.24 | 4.24 | 4.24 | 4.24 |
| Dequest 2066 | 0.875 | 0.875 | 0.875 | 0.875 | 0.875 | 0.875 |
| Opacifier | 0.0512 | 0.0512 | 0.0512 | 0.0512 | 0.0512 | 0.0512 |
| Perfume | 0.734 | 0.734 | 0.734 | 0.734 | 0.734 | 0.734 |
| Savinase | 2.262 | 2.262 | 2.262 | 2.262 | 2.262 | 2.262 |
| Stainzyme | 0.945 | 0.945 | 0.945 | 0.945 | 0.945 | 0.945 |
| EPEI# | 5.5 | 5.5 | 5.5 | 5.5 | 5.5 | 5.5 |
| Lipex | 0 | 3 | 0 | 0 | 3 | 0 |
| Borax | 10 | 10 | 10 | 10 | 10 | 10 |
| Lipolase | 0 | 0 | 3 | 0 | 0 | 3 |
| SRP* | 0 | 0 | 0 | 3.75 | 3.75 | 0 |

*Texcare SRN 170 (ex Clariant)

#EPEI = PEI(600) 20EO as used in examples 2-5

SLES and betaine are also as used in examples 2 to 5.

The formulations in examples 21 to 26 were tested against a control formulation without carbobetaine or EPEI or any Soil release polymer or lipase, as was done in examples 1 to 5 versus control A. The control used was Persil Small and Mighty™ which was dosed to 1.1 g/l non-soap surfactant from a 35 ml dose equivalent.

TABLE 11

Knitted cotton performance against control

| Class | Stain | 21 | 22 | 23 | 24 | 25 | 26 |
|---|---|---|---|---|---|---|---|
| particulate | Georgia clay | Same | Same | Better | Same | Same | Same |
| Fatty | lard | Same | Better | Better | Same | Better | Better |
| enzymatic | grass | Same | Better | Same | Same | Same | Better |
| Food sauces | Ragu | Same | Same | Same | Same | Same | Better |

Surprisingly addition of lipolase (Eg 23) shows an improved removal of Georgia clay when compared to the control, whereas lipex (Eg 22) does not. Replacement of enzyme with soil release polymer SRN170 (Eg 24) usefully gives the same performance as the control. Combination of the technologies in Eg 26 performs better than enzyme alone Eg 21 but against Eg 23 for effect of adding the SRP there is a surprising win on the key everyday enzymatic stain "grass" at these low non-soap surfactant levels in the wash.

TABLE 12

Knitted polyester performance against control

| Class | Stain | 21 | 22 | 23 |
|---|---|---|---|---|
| Particulate | Garden soil | Better | Better | Better |
| Particulate | Georgia clay | Same | Better | Better |
| Particulate | Red clay | Same | Better | Better |
| Particulate | Yellow clay | Better | Better | Better |
| Fatty | Lard | Same | Same | Same |
| Fatty | Cooking oil | Worse | Better | Same |
| Enzymatic | Grass | Same | Better | Same |
| Bleachable | blackcurrent | Same | Better | Better |
| Bleachable | Red wine | Better | Better | Better |
| Oils and greases | Mascara | Better | Better | Same |
| Food sauces | Ragu | Same | Better | Same |

| Class | Stain | 24 | 25 | 26 |
|---|---|---|---|---|
| Particulate | Garden soil | Better | Better | Better |
| Particulate | Georgia clay | Better | Better | Better |
| Particulate | Red clay | Same | Same | Same |
| Particulate | Yellow clay | Better | Better | Better |
| Fatty | Lard | Same | Same | Same |
| Fatty | Cooking oil | Better | Better | Same |
| Enzymatic | Grass | Same | Same | Better |
| Bleachable | blackcurrent | Better | Better | Same |
| Bleachable | Red wine | Better | Better | Better |
| Oils and greases | Mascara | Same | Same | Better |
| Food sauces | Ragu | Better | Better | Better |

Especially for example 26 further boosts in performance were seen on multi-washing. This is thought to be due to the enhanced deposition of the soil release polymer.

Examples 27 to 31

Effect of Addition of Lipase and SRP

To further understand if the results were due to the presence of SRP the tests were repeated, using the same 30 wt % surfactant base as the control comparison, (base). These examples (27 to 31—see table 13) are summarized in the comparative performance tables below (tables 14 and 15). Both the Lipex and the Lipolase had the same enzyme activity of 100,000 LU/g.

TABLE 13

| Eg 27 | Eg 28 | Eg 29 | Eg 30 | Eg 31 |
|---|---|---|---|---|
| 30% active + EPEI + Lipex | 30% active + EPEI + lipolase | 30% active + EPEI + SRP | 30% active + EPEI + Lipex + SRP | 30% active + EPEI + lipolase + SRP |

TABLE 14

Knitted cotton vs base

| Class | Stain | 27 | 28 | 29 | 30 | 31 |
|---|---|---|---|---|---|---|
| Particulate | Garden soil | Same | Same | Same | Better | Same |
| Particulate | Georgia clay | Same | Better | Same | Same | Same |
| Particulate | Red clay | Same | Same | Same | Same | Better |
| Fatty | Lard | Better | Better | Same | Better | Better |
| Fatty | Make up 1 | Same | Same | Same | Same | Better |
| Bleachable | Tea | Better | Same | Same | Better | Better |
| Emzymatic | Choc ice cream | Better | Same | Same | Better | Same |
| Food sauces | Ragu | Better | Better | Same | Better | Better |

TABLE 15

Knitted polyester vs base

| Class | Stain | 27 | 28 | 29 | 30 | 31 |
|---|---|---|---|---|---|---|
| particulate | Garden soil | Same | Same | Same | Better | Better |
| particulate | Georgia clay | Same | Same | Same | Same | Same |
| particulate | Red clay | Same | Same | Same | Same | Same |
| particulate | Yellow clay | Better | Better | Same | Better | Better |
| Fatty | lipstick | Same | Same | Better | Better | Better |
| Fatty | Cooking oil | Better | Better | Better | Better | Better |
| enzymatic | Choc ice cream | Better | Same | Same | Same | Same |
| enzymatic | Grass | Same | Same | Same | Same | Better |
| Food sauces | Annato oil | Better | Same | Better | Same | Better |
| Oils and greases | Mascara | Better | Better | Better | Better | Better |
| Food sauces | Ragu | Better | Same | Better | Better | Better |

Of particular note is that addition of both enzymes (Lipex and Lipolase) snows a significant win over base on lard stains on knitted cotton. Overall better performance from the Lipex than lipolase.

For the knitted polyester addition of lipex produces significant wins over base on particulate, fatty and food sauce stains. Addition of lipolase shows surprisingly improved first wash performance on the particulate and fatty stains, as seen with lipex, which is sold as a first wash lipase enzyme.

Addition of SRN170 soil release polymer gives significant wins on fatty, fatty/particulate and food sauce stains.

A combination of enzyme and SRN170 shows significant increase in performance of all stain groups, except bleachable.

Examples 32 to 36 Showing Deposition of Benefit Agent

Softness Delivery

A liquid detergent composition, comprising surfactant including betaine, EPEI at more than 5 wt %, and Lipase enzyme was made up into a wash solution for testing and buffered to pH9 (full composition details are given in table 16). The amount, used was equivalent, to a 20 ml dose to a front loading automatic washing machine. Cotton terry test pieces and various amounts of LBG-silicone were added, into the wash liquor. And the swatches were subjected to Linitest washes at 40° C. for a 45 minute main wash, followed by 2×10 min rinses, and, line drying. Softness of the test pieces was assessed by two trained panellists.

TABLE 16

Softening Compositions

| Ingredient | % wt |
|---|---|
| Neodol 25-7 | 12.74 |
| LAS acid | 8.49 |
| SLES 3EO | 4.24 |
| Carbobetaine | 1.5 |
| Fatty acid Prifac 5908 | 3.03 |
| EPEI | 5.5 |
| Lipex | 3 |
| Savinase | 2.36 |

| | | | |
|---|---|---|---|
| Eg 32 | Wash liquor alone | | Least soft |
| Eg 33 | +0.88% | LBG-Sil* | |
| Eg 34 | +1.75% | LBG-Sil* | |
| Eg 35 | +3.5% | LBG-Sil | |
| Eg 36 | +13.13% | LBG-Sil | Most soft |

*No perceivable difference between these.

LBG-Silicone gives perceivable softening from this liquid detergent composition. There is no appreciable difference in softening below 3.5 wt % LBG silicone. Above that, the amount of softening perceived increased with increasing levels of LBG silicone. LBG is thus shown to act as a very effective deposition aid for the silicone softening benefit agent in the compositions used according to the invention.

The invention claimed is:

1. A method of laundering fabric which comprises the steps of:

a) providing a pourable liquid detergent composition comprising at least 3 wt % to less than 9.5 wt % ethoxylated polyethyleneimine, 3 to 9 wt % of a soil release polymer selected from water soluble/miscible or dispersible polyesters and 10-40% wt of surfactant, essentially consisting of nonionic and/or anionic and/or zwitteronic surfactant, which 10-40% wt of surfactant preferably passes the Calcium Tolerance Test described herein, and in addition, no more than 10% wt, of a soap, with the proviso that any soap present is present as a minority in wt % terms of the total surfactant, b) diluting a dose of said detergent composition in water by a factor of greater than 500 to obtain a wash liquor which comprises 0.8 to 0.035 g/l of non-soap surfactant, and c) washing fabrics with the wash liquor so formed.

2. The method according to claim 1 wherein the composition comprises 5 to 20000 LU/g lipase.

3. The method according to claim 1 wherein the composition comprises ethoxylated polyethyleneimine, at a level of 4 to 9 wt % of the composition.

4. The method according to claim 1 wherein the composition comprises a soil release polymer, at a level of from 6 wt % to 8.0 wt % of the composition.

5. The method according to claim 1 wherein the 10 to 40% wt of non-soap surfactant in the composition comprises less than 90% wt LAS and at least 10% wt nonionic surfactant.

6. The method according to claim 1 wherein the composition comprises a shading dye, comprising blue violet dye, preferably with an optical adsorption peak in the range 540 to 600 nm, preferably a bis-azo direct dye, preferably at a level of 0.000001 to 1 wt % of the composition.

7. The method according to claim 1 wherein the composition comprises a fluorescer at a level of 0.005 to 2 wt % of the composition.

8. The method according to claim 1 wherein the composition comprises a dye transfer inhibition polymer at a level of from 0.03 to 6 wt % of the composition.

9. The method according to claim 1 wherein the composition comprises a polycarboxylate anti-redeposition agent at a level of from 0.03 to 6 wt % of the composition.

10. The method according to claim 1 wherein the composition comprises a first wash lipase which comprises a polypeptide having a first amino acid sequence which has at least 90% sequence identity with a second amino acid sequence of a wild-type lipase derived from *Humicola lanuginose* strain DSM 4109, wherein the second amino acid sequence is shown in positions 1-269 of SEQ. ID. NO: 2 of U.S. Pat. No. 5,869,438.

11. The method according to claim 1 wherein the composition comprises a deposition aid wherein the deposition aid is at least one of a polysaccharide and locust bean gum.

12. The method according to claim 1 wherein the wt % of EPEI to non-soap surfactant is in a ratio of from 1:2 to 1:7.

13. The method according to claim 10 wherein the first amino acid sequence of the first wash lipase, compared to the second amino acid sequence of said wild-type lipase, comprises a substitution of an electrically neutral or negatively charged amino acid within 15 A of E1 or Q249 with a positively charged amino acid; and wherein:

i) the first amino acid sequence of the first wash lipase comprises a negatively charged amino acid in position E210 of the second amino acid sequence of said wild-type lipase;

ii) the first amino acid sequence of the first wash lipase comprises a negatively charged amino acid in the region corresponding to positions 90-101 of the second amino acid sequence of said wild-type lipase; and iii) the first amino acid sequence of the first wash lipase comprises a neutral or negatively charged amino acid at a position corresponding to N94 of the second amino acid sequence of said wild-type lipase, and/or has a negative charge or neutral charge in the region corresponding to position 9-1010 of the second amino acid sequence of said wild-type lipase.

14. The method according to claim 11 wherein the polysaccharide is a β-1,4-linked polysaccharide.

15. The method according to claim 2, wherein the lipase is selected from the group consisting of:

i) a *Humicola* lipase which is a lipase derived from *Humicola lanuginose* strain DSM 4109, wherein the *Humicola* lipase has an amino acid sequence shown in positions 1-269 of SEQ. ID. NO: 2 of U.S. Pat. No. 5,869,438;

ii) a chemically modified mutant of the *Humicola* lipase; and iii) a protein engineered mutant of the *Humicola* lipase.

* * * * *